US011658405B2

(12) United States Patent
Morimoto et al.

(10) Patent No.: US 11,658,405 B2
(45) Date of Patent: May 23, 2023

(54) ANTENNA-ATTACHED SUBSTRATE AND ANTENNA MODULE

(71) Applicant: Murata Manufacturing Co., Ltd., Kyoto (JP)

(72) Inventors: Yuta Morimoto, Kyoto (JP); Issei Yamamoto, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/896,378

(22) Filed: Jun. 9, 2020

(65) Prior Publication Data

US 2020/0303813 A1 Sep. 24, 2020

Related U.S. Application Data

(63) Continuation of application No. PCT/JP2018/038509, filed on Oct. 16, 2018.

(30) Foreign Application Priority Data

Dec. 11, 2017 (JP) ..... JP2017-236893

(51) Int. Cl.
*H01Q 1/40* (2006.01)
*H01Q 23/00* (2006.01)

(52) U.S. Cl.
CPC ..... *H01Q 1/40* (2013.01); *H01Q 23/00* (2013.01)

(58) Field of Classification Search
CPC ..... H01Q 1/40; H01Q 23/00; H01Q 9/0414; H01Q 21/065
See application file for complete search history.

(56) References Cited

U.S. PATENT DOCUMENTS 5,880,694 A 3/1999 Wang
2007/0126638 A1 6/2007 Channabasappa
(Continued)

FOREIGN PATENT DOCUMENTS

JP S59-207703 A 11/1984
JP H03-074908 A 3/1991
(Continued)

OTHER PUBLICATIONS

Bhardwaj, "The Characteristics of Electromagnetically Coupled Two Layered Dielectric Loaded Patch Antenna", International Journal of Electromagnetics and Applications 2013, 3(4), pp. 43-64. (Year: 2013).*

(Continued)

*Primary Examiner* — Dieu Hien T Duong
(74) *Attorney, Agent, or Firm* — Pearne & Gordon LLP

(57) ABSTRACT

An antenna-attached substrate according to the present disclosure includes a substrate layer, a lower antenna element that is disposed in the substrate layer, an antenna-holding layer that is stacked on an upper surface of the substrate layer, and an upper antenna element that is disposed in the antenna-holding layer and that faces an upper surface of the lower antenna element. The antenna-holding layer is composed of a dielectric material having a relative dielectric constant lower than that of the substrate layer. A lower surface, a side surface, and an upper surface of the upper antenna element are covered by the antenna-holding layer.

20 Claims, 3 Drawing Sheets

(56) References Cited

U.S. PATENT DOCUMENTS

| | | | | |
|---|---|---|---|---|
| 2015/0138030 | A1* | 5/2015 | Yosui | H01Q 7/06 343/787 |
| 2015/0188228 | A1* | 7/2015 | Yosui | H01Q 1/243 343/788 |
| 2016/0261047 | A1* | 9/2016 | Wallace | H01Q 9/0414 |
| 2017/0222316 | A1 | 8/2017 | Mizunuma et al. | |
| 2017/0346185 | A1* | 11/2017 | Wang | H01Q 1/2283 |
| 2018/0212307 | A1* | 7/2018 | Kim | H01Q 1/48 |

FOREIGN PATENT DOCUMENTS

| | | | | |
|---|---|---|---|---|
| JP | H05-160627 | A | 6/1993 | |
| JP | H09-036645 | A | 2/1997 | |
| JP | H09-238019 | A | 9/1997 | |
| JP | 2003-283239 | A | 10/2003 | |
| KR | 101014352 | B1 | 2/2011 | |
| WO | 2012/029650 | A1 | 3/2012 | |
| WO | WO-2012081288 | A1 * | 6/2012 | H01Q 1/2283 |
| WO | 2016/063759 | A1 | 4/2016 | |

OTHER PUBLICATIONS

Saks, "The Characteristics of Electromagnetically Coupled Two Layered Dielectric Loaded Patch Antenna", International Journal of Electromagnetics and Applications 2013, pp. 43-64. (Year: 2013).*

International Search Report for International Application No. PCT/JP2018/038509, dated Jan. 15, 2019.

Written Opinion for International Application No. PCT/JP2018/038509, dated Jan. 15, 2019.

Japanese Office action for Application No. 2019-558941 dated Mar. 23, 2021.

Chinese Office action for 201880079487.3 dated Jan. 6, 2022.

* cited by examiner

ANTENNA-ATTACHED SUBSTRATE AND ANTENNA MODULE

This is a continuation of International Application No. PCT/JP2018/038509 filed on Oct. 16, 2018 which claims priority from Japanese Patent Application No. 2017-236893 filed on Dec. 11, 2017. The contents of these applications are incorporated herein by reference in their entireties.

BACKGROUND

Technical Field

The present disclosure relates to an antenna-attached substrate and an antenna module.

In an antenna-attached substrate, a first antenna element is disposed above a second antenna element. For example, Patent Document 1 discloses an antenna device that includes a power-supply excitation element (lower antenna element) that is dispose on a surface of a first dielectric plate and a non-power-supply excitation element (upper antenna element) that is disposed on a surface of a second dielectric plate. In the antenna device disclosed in Patent Document 1, a leg portion is disposed between the first dielectric plate and the second dielectric plate, and there is a space between the power-supply excitation element and the non-power-supply excitation element.

Patent Document 1 discloses that the power-supply excitation element and the non-power-supply excitation element are disposed with the second dielectric plate and a dielectric spacer interposed therebetween in the existing antenna device.

Patent Document 1: Japanese Unexamined Patent Application Publication No. 2003-283239

BRIEF SUMMARY

The antenna device disclosed in Patent Document 1 has a space having a relative dielectric constant that is much lower than that of an existing dielectric spacer between the power-supply excitation element and the non-power-supply excitation element. Since the relative dielectric constant between the power-supply excitation element and the non-power-supply excitation element decreases, an electromagnetic wave loss can supposedly decrease. The leg portion that is disposed between the first dielectric plate and the second dielectric plate is unlikely to deform unlike the existing dielectric spacer. Accordingly, the distance between the power-supply excitation element and the non-power-supply excitation element is kept constant, and antenna characteristics can be supposedly maintained.

However, the location of the non-power-supply excitation element may make it difficult to keep a constant distance between the non-power-supply excitation element corresponding to the upper antenna element and the power-supply excitation element corresponding to the lower antenna element. For example, in the case where the upper antenna element is embedded in the second dielectric plate, the amount of a dielectric material that is located on each side surface of the upper antenna element varies depending on the quantity of embedment. Consequently, there is a possibility that the antenna characteristics are not stable. In the case where the upper antenna element is disposed on the surface of the second dielectric plate, there is a possibility that misalignment of the upper antenna element in a plane direction occurs, and the antenna characteristics are not stable.

The present disclosure provides an antenna-attached substrate that has a low relative dielectric constant between antenna elements and that has stable antenna characteristics. The present disclosure provides an antenna module that includes an electronic component that is mounted on the antenna-attached substrate.

An antenna-attached substrate according to the present disclosure includes a substrate layer, a lower antenna element that is disposed in the substrate layer, an antenna-holding layer that is stacked on an upper surface of the substrate layer, and an upper antenna element that is disposed in the antenna-holding layer and that faces an upper surface of the lower antenna element. The antenna-holding layer is composed of a dielectric material having a relative dielectric constant lower than that of the substrate layer. A lower surface, a side surface, and an upper surface of the upper antenna element are covered by the antenna-holding layer.

In the antenna-attached substrate according to the present disclosure, a degree of surface roughness of the upper surface of the upper antenna element can be greater than a degree of surface roughness of the lower surface.

In the antenna-attached substrate according to the present disclosure, the upper antenna element may have a reversely tapered shape an upper surface of which has an area smaller than an area of a lower surface.

In the antenna-attached substrate according to the present disclosure, the antenna-holding layer can include a first antenna-holding layer that covers the upper surface of the upper antenna element and a second antenna-holding layer that covers the lower surface of the upper antenna element.

In the antenna-attached substrate according to the present disclosure, the upper antenna element may be partly embedded in the second antenna-holding layer.

In the antenna-attached substrate according to the present disclosure, the first antenna-holding layer may be composed of the same material as the second antenna-holding layer.

In the antenna-attached substrate according to the present disclosure, the first antenna-holding layer may be composed of a material that differs from that of the second antenna-holding layer. In this case, a relative dielectric constant of the first antenna-holding layer may be higher than a relative dielectric constant of the second antenna-holding layer.

In the antenna-attached substrate according to the present disclosure, an area of the lower surface of the upper antenna element may be larger than an area of the upper surface of the facing lower antenna element.

In the antenna-attached substrate according to the present disclosure, the upper surface of the lower antenna element may be covered by the substrate layer.

An antenna module according to the present disclosure includes the antenna-attached substrate according to the present disclosure and an electronic component that is mounted on the antenna-attached substrate.

In the antenna module according to the present disclosure, the electronic component can be mounted on a main surface of the antenna-attached substrate that is near the lower surface of the substrate layer.

According to the present disclosure, an antenna-attached substrate that has a low relative dielectric constant between antenna elements and that has stable antenna characteristics can be provided.

DETAILED DESCRIPTION

Antenna-attached substrates and an antenna module according to the present disclosure will hereinafter be described. However, the present disclosure is not limited to embodiments described below and can be appropriately modified and used without necessarily departing from the spirit of the present disclosure. The present disclosure includes an embodiment obtained by combining two or more structures described below.

It goes without necessarily saying that the embodiments will be described by way of example, and that structures described according to the different embodiments can be partly replaced and combined. In descriptions according to a second embodiment and later, a description of matters common to those according to a first embodiment is omitted, and only different matters will be described. In particular, the same effects achieved by the same structures are not described for every embodiment.

Antenna-Attached Substrate

First Embodiment

Figure 1:
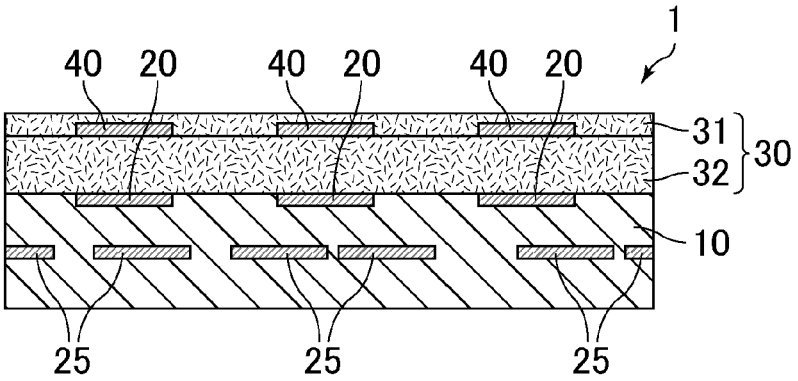
FIG. 1 is a schematic sectional view of an example of an antenna-attached substrate according to a first embodiment of the present disclosure.

An antenna-attached substrate according to the first embodiment of the present disclosure will now be described. FIG. 1 is a schematic sectional view of an example of the antenna-attached substrate according to the first embodiment of the present disclosure.

In the present specification, an upper part in FIG. 1 is represented by using the term "upper", and a lower part is represented by using the term "lower" for convenience of a description. The same is true of FIG. 2 and later. Regarding the antenna-attached substrates according to the present disclosure, the terms "upper" and "lower" mean relative directions of the antenna-attached substrate and do not mean "upward in the vertical direction" or "downward in the vertical direction".

An antenna-attached substrate 1 illustrated in FIG. 1 includes a substrate layer 10, lower antenna elements 20 that are disposed in the substrate layer 10, an antenna-holding layer 30 that is stacked on the upper surface of the substrate layer 10, and upper antenna elements 40 that are disposed in the antenna-holding layer 30. The upper antenna elements 40 face the upper surfaces of the lower antenna elements 20.

In the antenna-attached substrate 1 illustrated in FIG. 1, the lower antenna elements 20 and the upper antenna elements 40 are formed by multiple patterns but may be formed by a single pattern. In any case, the lower antenna elements 20 and the upper antenna elements 40 can be disposed so as to overlap in the thickness direction.

In the antenna-attached substrate 1 illustrated in FIG. 1, the substrate layer 10 includes wiring lines 25 as needed. The substrate layer 10 may have a multilayer structure.

A part of each lower antenna element 20 can be located in the substrate layer 10. In FIG. 1, the lower surface and the side surfaces of the lower antenna element 20 are covered by the substrate layer 10, and the upper surface of the lower antenna element 20 is covered by the antenna-holding layer 30.

The antenna-holding layer 30 is composed of a material having a relative dielectric constant lower than that of the substrate layer 10. The antenna-holding layer is interposed between the lower antenna elements and the upper antenna elements. This enables the relative dielectric constant between the antenna elements to be lower than that in the case where the substrate layer is interposed therebetween and enables antenna characteristics to be improved.

In the antenna-attached substrate 1 illustrated in FIG. 1, the lower surface, the side surfaces, and the upper surface of each upper antenna element 40 are covered by the antenna-holding layer 30. That is, the upper antenna element 40 is not exposed from any surface of the antenna-holding layer 30. In the case where the upper antenna element is exposed from a surface of the antenna-holding layer, and the upper antenna element is partly embedded in the antenna-holding layer, there is a possibility that the amount of a dielectric material that is located on the side surfaces of the upper antenna element varies, and that the antenna characteristics are not unstable. However, covering the entire surface of the upper antenna element by the antenna-holding layer eliminates variation in the antenna characteristics due to a difference in the relative dielectric constant, and the antenna characteristics are stable.

Covering the entire surface of each upper antenna element by the antenna-holding layer prevents misalignment in the plane direction with respect to the lower antenna elements, and the antenna characteristics are stable.

Covering the entire surface of each upper antenna element by the antenna-holding layer enables the degree of close contact between the antenna-holding layer and the upper antenna element to be increased, and reliability is improved.

As illustrated in FIG. 1, the antenna-holding layer 30 can include a first antenna-holding layer 31 that covers the upper surface of each upper antenna element 40 and a second antenna-holding layer 32 that covers the lower surface of the upper antenna element 40. The first antenna-holding layer 31 is composed of the same material as the second antenna-holding layer 32.

In the antenna-attached substrate 1 illustrated in FIG. 1, each upper antenna element 40 is disposed on the upper surface of the second antenna-holding layer 32, and the lower surface of the upper antenna element 40 is flush with the boundary between the first antenna-holding layer 31 and the second antenna-holding layer 32.

In the antenna-attached substrate according to the first embodiment of the present disclosure, the degree of the surface roughness of the upper surface of each upper antenna element can be greater than the degree of the surface roughness of the lower surface. When the degree of the surface roughness of the upper surface of the upper antenna element is high, misalignment of the antenna element is unlikely to occur, and the antenna characteristics are stable. As the degree of the surface roughness of the upper surface of the upper antenna element increases, adhesion to the antenna-holding layer increases because of an anchor effect, and the reliability is improved. As the degree of the surface roughness of the lower surface of the upper antenna element decreases, a transmission loss of a radio wave decreases, and the antenna characteristics are improved. The surface roughness means a maximum height (Rz). The maximum height (Rz) can be obtained by polishing a cross section and measuring a difference between the maximum value and the minimum value of unevenness.

Each upper antenna element is formed, for example, by patterning a copper foil by using photolithography. The surface roughness of the front surface of the copper foil typically differs from the surface roughness of the back surface thereof. One of the surfaces is a glossy surface, and the other is a rough surface. Accordingly, the degree of the surface roughness of the upper surface of the upper antenna element can be greater than the degree of the surface roughness of the lower surface by stacking such that the glossy surface of the copper foil faces downward, and such that the rough surface faces upward.

An example of the material of the substrate layer is a ceramic material, such as a low-temperature co-fired ceramic (LTCC) material. The low-temperature co-fired ceramic material means a ceramic material that can be sintered at a firing temperature of 1000° C. or less and that can be co-fired with copper or silver. The material of the substrate layer may be a resin material, such as a glass epoxy resin.

Examples of the low-temperature co-fired ceramic material include a glass composite low-temperature co-fired ceramic material that is a mixture of a ceramic material, such as quartz, alumina, or forsterite and borosilicate glass, a crystallized glass low-temperature co-fired ceramic material using ZnO—MgO—$Al_2O_3$—$SiO_2$ crystallized glass, and a non-glass low-temperature co-fired ceramic material using, for example, a BaO—$Al_2O_3$—$SiO_2$ ceramic material or an $Al_2O_3$—CaO—$SiO_2$—MgO—$B_2O_3$ ceramic material.

The relative dielectric constant of the substrate layer is not particularly limited, provided that the relative dielectric constant is higher than the relative dielectric constant of the antenna-holding layer but can be 5 or more, can be more than 10, and can be 20 or less.

The dielectric material of the antenna-holding layer can be a resin material. Examples of the resin material include a fluorine resin, silicone rubber, a hydrocarbon resin having few polar groups (for example, polyethylene, polypropylene, or polystyrene). Specific examples can include a fluorine resin satisfying $\varepsilon r=2.6$, silicone rubber satisfying $\varepsilon r=3.0$, polyethylene satisfying $\varepsilon r=2.25$, polypropylene satisfying $\varepsilon r=2.2$, and polystyrene satisfying $\varepsilon r=2.45$, where $\varepsilon r$ is the relative dielectric constant.

The relative dielectric constant of the antenna-holding layer is not particularly limited, provided that the relative dielectric constant is lower than the relative dielectric constant of the substrate layer but can be 3 or less and can be 1.5 or more.

The thickness of the antenna-holding layer is not particularly limited, provided that the upper surface of each upper antenna element is covered but can be equal to or more than the thickness of the substrate layer from the perspective of improvement in the antenna characteristics. For example, the distance between the upper surface of each lower antenna element and the lower surface of the upper antenna element is no less than 200 μm and no more than 400 μm. To decrease the height of a product, the use of a material having a low relative dielectric constant enables the required characteristics to be obtained even when the thickness of the antenna-holding layer is decreased.

The relative dielectric constant of the antenna-holding layer is higher than the relative dielectric constant ($\varepsilon r\approx 1$) of air. For this reason, when a portion of the antenna-holding layer that covers the upper surface of each upper antenna element is too thick, there is a possibility that the antenna characteristics are degraded. Accordingly, for example, the portion of the antenna-holding layer that covers the upper surface of the upper antenna element can be 50 μm or less.

An example of a method of manufacturing the antenna-attached substrate according to the first embodiment of the present disclosure will now be described.

A circuit board in which the lower antenna elements are formed in a surface layer is first manufactured. For example, a LTCC substrate that includes the lower antenna elements is manufactured by using a low-temperature co-fired ceramic material. The lower antenna elements can be formed in accordance with an electrode formation process used for manufacturing a typical LTCC substrate.

A material having a relative dielectric constant higher than that of the material of the antenna-holding layer is selected as the low-temperature co-fired ceramic material of the substrate layer.

The material of each lower antenna element can be copper or silver. The material of the lower antenna element and the material of each upper antenna element may be the same as each other or may differ from each other.

The antenna-holding layer is stacked on a main surface of the circuit board that is near the lower antenna elements. For example, a dielectric film that is mainly composed of a dielectric material, such as the above resin material is stacked as the antenna-holding layer by thermo-compression bonding. A stacking method may be a typical rolling method, diaphragm method, or planar pressing method.

A copper foil is stacked on the dielectric film (antenna-holding layer) by thermo-compression bonding. Since the surface roughness of the front surface of the copper foil typically differs from the surface roughness of the back surface thereof, the copper foil is stacked such that the glossy surface faces downward, and the rough surface faces upward.

Subsequently, the upper antenna elements are formed by photolithography so as to face the lower antenna elements. Specifically, a resist is applied to the copper foil, and the copper foil is subsequently etched to remove portions of the copper foil that are not covered by the resist. Subsequently, the resist is removed. At this time, because positional relationships between the upper antenna elements and the lower antenna elements in the plane direction affect the characteristics, the upper antenna elements may be formed such that the quantity of the misalignment in the plane direction is equal to or less than half of the distance between the antenna elements in the height direction.

The thickness of the copper foil can be no less than 5 μm and no more than 20 μm from the perspective of both of easy handling during stacking and an etching time. When the glossy surface faces downward as above, a transmission loss of a radio wave decreases, and the antenna characteristics are improved.

The dielectric film (antenna-holding layer) having a thickness equal to or more than that of each upper antenna element is finally pressed and stacked in the height direction by using a high-temperature press machine such that a step due to the thickness of the upper antenna element can be sufficiently covered. Consequently, the upper antenna element is embedded in the antenna-holding layer. At this time, the rough surface of the upper antenna element faces upward. This enables the adhesion to the antenna-holding layer to be increased because of the anchor effect. Accordingly, the antenna characteristics are prevented from being degraded due to the misalignment of the antenna elements, and the reliability are improved.

In the above manner, the antenna-attached substrate according to the first embodiment of the present disclosure is obtained.

Second Embodiment

According to the second embodiment of the present disclosure, each upper antenna element has a reversely tapered shape.

Figure 2:
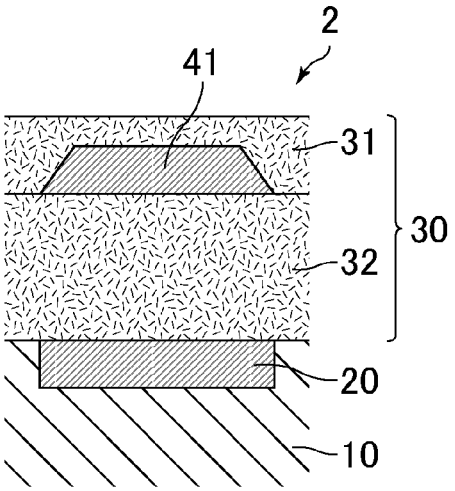
FIG. 2 is a schematic sectional view of an example of an antenna-attached substrate according to a second embodiment of the present disclosure.

FIG. 2 is a schematic sectional view of an example of an antenna-attached substrate according to the second embodiment of the present disclosure. FIG. 2 does not illustrate the entire structure. An antenna-attached substrate 2 includes the substrate layer 10, the lower antenna elements 20 that are disposed in the substrate layer 10, the antenna-holding layer 30 that is stacked on the upper surface of the substrate layer 10, and upper antenna elements 41 that are disposed in the antenna-holding layer 30. The upper antenna elements 41 face the upper surfaces of the lower antenna elements 20.

As illustrated in FIG. 2, the antenna-holding layer 30 can include the first antenna-holding layer 31 that covers the upper surface of each upper antenna element 41 and the second antenna-holding layer 32 that covers the lower surface of the upper antenna element 41. The first antenna-holding layer 31 is composed of the same material as the second antenna-holding layer 32.

In the antenna-attached substrate 2 illustrated in FIG. 2, each upper antenna element 41 has a reversely tapered shape the upper surface of which has an area smaller than the area of the lower surface. The reversely tapered shape of the upper antenna element enables a wedge effect to prevent the upper antenna element from coming out upward. Accordingly, the antenna characteristics and the reliability are further improved.

The structure of the antenna-attached substrate 2 illustrated in FIG. 2 is common to that of the antenna-attached substrate 1 illustrated in FIG. 1 except that each upper antenna element 41 has the reversely tapered shape.

As described according to the first embodiment of the present disclosure, each upper antenna element is formed by, for example, photolithography. In this case, when the copper foil is etched, the upper antenna element that has the reversely tapered shape can be readily formed.

The reversely tapered shape of each upper antenna element makes air entrainment unlikely to occur when the dielectric film (antenna-holding layer) is stacked after the upper antenna element is formed. Accordingly, stacking can be performed with low-cost equipment, and manufacturing costs can be decreased.

In the antenna-attached substrate according to the second embodiment of the present disclosure, the shape of each upper antenna element is not particularly limited, provided that the area of the upper surface of the upper antenna element is smaller than the area of the lower surface. For example, the area of the upper surface of the upper antenna element is no less than 70% and no more than 90% of the area of the lower surface.

In the antenna-attached substrate according to the second embodiment of the present disclosure, the lower antenna elements and the upper antenna elements may be formed by multiple patterns or may be formed by a single pattern. In any case, the lower antenna elements and the upper antenna elements can be disposed so as to overlap in the thickness direction. In the case where the lower antenna elements and the upper antenna elements are formed by multiple patterns, all of the upper antenna elements can have the reversely tapered shape. The shapes of the upper antenna elements may be the same as each other or may differ from each other.

In the antenna-attached substrate according to the second embodiment of the present disclosure, the degree of the surface roughness of the upper surface of each upper antenna element can be greater than the degree of the surface roughness of the lower surface.

Third Embodiment

According to a third embodiment of the present disclosure, the antenna-holding layer includes the first antenna-holding layer and the second antenna-holding layer, and each upper antenna element is partly embedded in the second antenna-holding layer.

Figure 3:
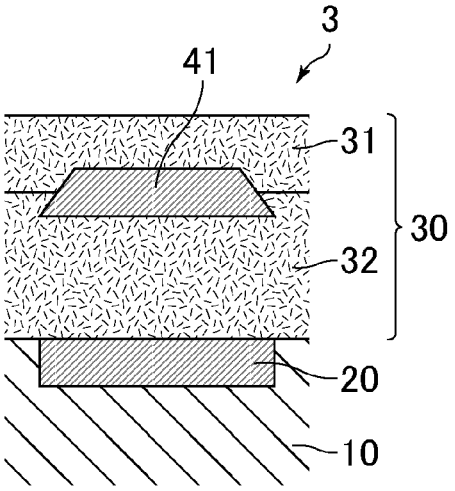
FIG. 3 is a schematic sectional view of an example of an antenna-attached substrate according to a third embodiment of the present disclosure.

FIG. 3 is a schematic sectional view of an example of an antenna-attached substrate according to the third embodiment of the present disclosure. FIG. 3 does not illustrate the entire structure. An antenna-attached substrate 3 includes the substrate layer 10, the lower antenna elements 20 that are disposed in the substrate layer 10, the antenna-holding layer 30 that is stacked on the upper surface of the substrate layer 10, and the upper antenna elements 41 that are disposed in the antenna-holding layer 30. The upper antenna elements 41 face the upper surfaces of the lower antenna elements 20.

As illustrated in FIG. 3, the antenna-holding layer 30 includes the first antenna-holding layer 31 that covers the upper surface of each upper antenna element 41, and the second antenna-holding layer 32 that covers the lower surface of the upper antenna element 41. The first antenna-holding layer 31 is composed of the same material as the second antenna-holding layer 32.

In the antenna-attached substrate 3 illustrated in FIG. 3, each upper antenna element 41 is partly embedded in the second antenna-holding layer 32. The upper antenna element that is partly embedded in the second antenna-holding layer is firmly held. Accordingly, the antenna characteristics and the reliability are further improved.

The structure of the antenna-attached substrate 3 illustrated in FIG. 3 is common to that of the antenna-attached substrate 2 illustrated in FIG. 2 except that the upper antenna elements 41 are partly embedded in the second antenna-holding layer 32. The antenna-attached substrate 3 illustrated in FIG. 3 may include the upper antenna elements 40 illustrated in FIG. 1 instead of the upper antenna elements 41.

In the antenna-attached substrate according to the third embodiment of the present disclosure, the shapes of the upper antenna elements and the degree of embedment thereof are not particularly limited, provided that the upper antenna elements are partly embedded in the second antenna-holding layer. For example, a portion of each upper antenna element corresponding to 50% of the height or more can be embedded in the second antenna-holding layer.

In the antenna-attached substrate according to the third embodiment of the present disclosure, the lower antenna elements and the upper antenna elements may be formed by multiple patterns or may be formed by a single pattern. In any case, the lower antenna elements and the upper antenna elements can be disposed so as to overlap in the thickness direction. In the case where the lower antenna elements and the upper antenna elements are formed by multiple patterns, all of the upper antenna elements can be partly embedded in the second antenna-holding layer. The upper antenna elements may have the same shape and the same degree of embedment or may have different shapes and different degrees of embedment.

In the antenna-attached substrate according to the third embodiment of the present disclosure, the degree of the surface roughness of the upper surface of each upper antenna element can be greater than the degree of the surface roughness of the lower surface.

Fourth Embodiment

According to a fourth embodiment of the present disclosure, the area of the lower surface of each upper antenna element is larger than the area of the upper surface of the facing lower antenna element.

Figure 4:
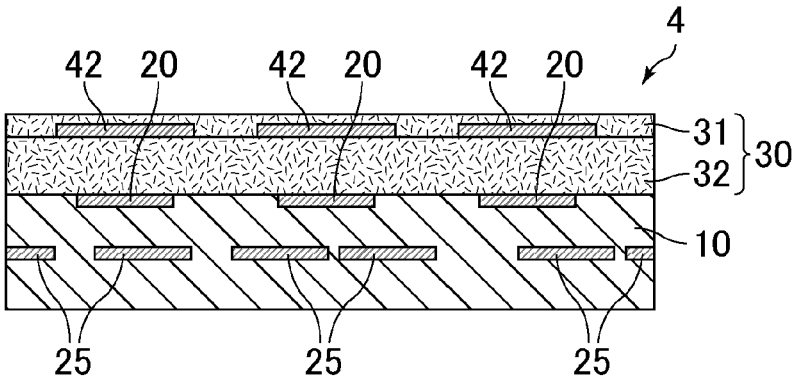
FIG. 4 is a schematic sectional view of an example of an antenna-attached substrate according to a fourth embodiment of the present disclosure.

FIG. 4 is a schematic sectional view of an example of an antenna-attached substrate according to the fourth embodiment of the present disclosure. An antenna-attached substrate 4 illustrated in FIG. 4 includes the substrate layer 10, the lower antenna elements 20 that are disposed in the substrate layer 10, the antenna-holding layer 30 that is stacked on the upper surface of the substrate layer 10, and upper antenna elements 42 that are disposed in the antenna-holding layer 30. The upper antenna elements 42 face the upper surfaces of the lower antenna elements 20. The substrate layer 10 includes the wiring lines 25 as needed.

As illustrated in FIG. 4, the antenna-holding layer 30 can include the first antenna-holding layer 31 that covers the upper surface of each upper antenna element 42, and the second antenna-holding layer 32 that covers the lower surface of the upper antenna element 42. The first antenna-holding layer 31 is composed of the same material as the second antenna-holding layer 32.

In the antenna-attached substrate 4 illustrated in FIG. 4, the area of the lower surface of each upper antenna element 42 is larger than the area of the upper surface of the facing lower antenna element 20. When the area of the upper antenna element is larger than the area of the lower antenna element, a radio wave that is emitted from the lower antenna element can be sufficiently received even when misalignment of the antenna elements slightly occurs, and the antenna characteristics are stable.

The structure of the antenna-attached substrate 4 illustrated in FIG. 4 is common to that of the antenna-attached substrate 1 illustrated in FIG. 1 except that the area of the lower surface of each upper antenna element 42 is larger than the area of the upper surface of the facing lower antenna element 20.

In the antenna-attached substrate according to the fourth embodiment of the present disclosure, the shapes of each upper antenna element and each lower antenna element are not particularly limited, provided that the area of the lower surface of the upper antenna element is larger than the area of the upper surface of the facing lower antenna element. For example, the area of the lower surface of the upper antenna element can be no less than 110% and no more than 250% of the area of the upper surface of the facing lower antenna element.

In the antenna-attached substrate according to the fourth embodiment of the present disclosure, the lower antenna elements and the upper antenna elements may be formed by multiple patterns or may be formed by a single pattern. In any case, the lower antenna elements and the upper antenna elements can be disposed so as to overlap in the thickness direction. In the case where the lower antenna elements and the upper antenna elements are formed by multiple patterns, the areas of the lower surfaces of all of the upper antenna elements can be larger than the areas of the upper surfaces of the facing lower antenna elements. The shapes of the upper antenna elements and the lower antenna elements may be the same as each other or may differ from each other.

In the antenna-attached substrate according to the fourth embodiment of the present disclosure, the degree of the surface roughness of the upper surface of each upper antenna element can be greater than the degree of the surface roughness of the lower surface.

In the antenna-attached substrate according to the fourth embodiment of the present disclosure, each upper antenna element may have a reversely tapered shape the upper surface of which has an area smaller than the area of the lower surface.

In the case where the antenna-holding layer includes the first antenna-holding layer and the second antenna-holding layer in the antenna-attached substrate according to the fourth embodiment of the present disclosure, each upper antenna element may be partly embedded in the second antenna-holding layer.

Fifth Embodiment

According to a fifth embodiment of the present disclosure, the upper surface of each lower antenna element is covered by the substrate layer.

Figure 5:
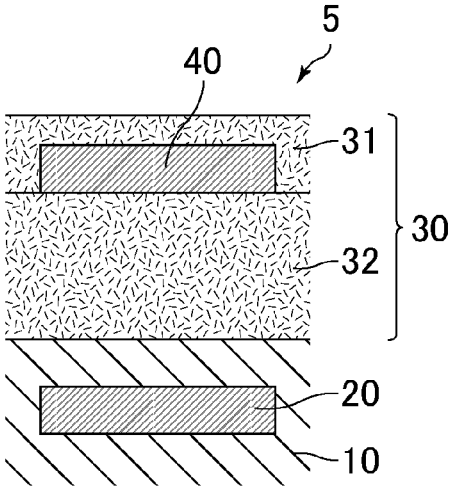
FIG. 5 is a schematic sectional view of an example of an antenna-attached substrate according to a fifth embodiment of the present disclosure.

FIG. 5 is a schematic sectional view of an example of an antenna-attached substrate according to the fifth embodiment of the present disclosure. FIG. 5 does not illustrate the entire structure. An antenna-attached substrate 5 includes the substrate layer 10, the lower antenna elements 20 that are disposed in the substrate layer 10, the antenna-holding layer 30 that is stacked on the upper surface of the substrate layer 10, and the upper antenna elements 40 that are disposed in the antenna-holding layer 30. The upper antenna elements 40 face the upper surfaces of the lower antenna elements 20.

As illustrated in FIG. 5, the antenna-holding layer 30 can include the first antenna-holding layer 31 that covers the upper surface of each upper antenna element 40, and the second antenna-holding layer 32 that covers the lower surface of the upper antenna element 40. The first antenna-holding layer 31 is composed of the same material as the second antenna-holding layer 32.

In the antenna-attached substrate 5 illustrated in FIG. 5, the upper surface of each lower antenna element 20 is covered by the substrate layer 10. Covering the upper surface of the lower antenna element by the substrate layer improves corrosion resistance of the antenna element before the dielectric film (antenna-holding layer) is stacked and prevents damage thereto due to, for example, handling.

The structure of the antenna-attached substrate 5 illustrated in FIG. 5 is common to that of the antenna-attached substrate 1 illustrated in FIG. 1 except that the upper surface of each lower antenna element 20 is covered by the substrate layer 10.

In the antenna-attached substrate according to the fifth embodiment of the present disclosure, the thickness of a portion of the substrate layer that covers the upper surface of each lower antenna element is not particularly limited, provided that the upper surface of the lower antenna element is covered but can be decreased as much as possible from the perspective of a decrease in the relative dielectric constant between the antenna elements. For example, the thickness of the position of the substrate layer that covers the upper surface of each lower antenna element can be equal to or less than 20% of the distance between the lower surface of the upper antenna element and the upper surface of the lower antenna element. Specifically, the thickness can be 60 μm or less.

In the antenna-attached substrate according to the fifth embodiment of the present disclosure, the lower antenna elements and the upper antenna elements may be formed by multiple patterns or may be formed by a single pattern. In any case, the lower antenna elements and the upper antenna elements can be disposed so as to overlap in the thickness direction. In the case where the lower antenna elements and the upper antenna elements are formed by multiple patterns, the upper surfaces of all of the lower antenna elements can be covered by the substrate layer.

In the antenna-attached substrate according to the fifth embodiment of the present disclosure, the degree of the surface roughness of the upper surface of each upper antenna element can be greater than the degree of the surface roughness of the lower surface.

In the antenna-attached substrate according to the fifth embodiment of the present disclosure, each upper antenna element may have a reversely tapered shape the upper surface of which has an area smaller than the area of the lower surface.

In the case where the antenna-holding layer includes the first antenna-holding layer and the second antenna-holding layer in the antenna-attached substrate according to the fifth embodiment of the present disclosure, each upper antenna element may be partly embedded in the second antenna-holding layer.

In the antenna-attached substrate according to the fifth embodiment of the present disclosure, the area of the lower surface of each upper antenna element may be larger than the area of the upper surface of the facing lower antenna element.

Sixth Embodiment

According to a sixth embodiment of the present disclosure, the antenna-holding layer includes the first antenna-holding layer and the second antenna-holding layer, and the first antenna-holding layer is composed of a material that differs from that of the second antenna-holding layer.

Figure 6:
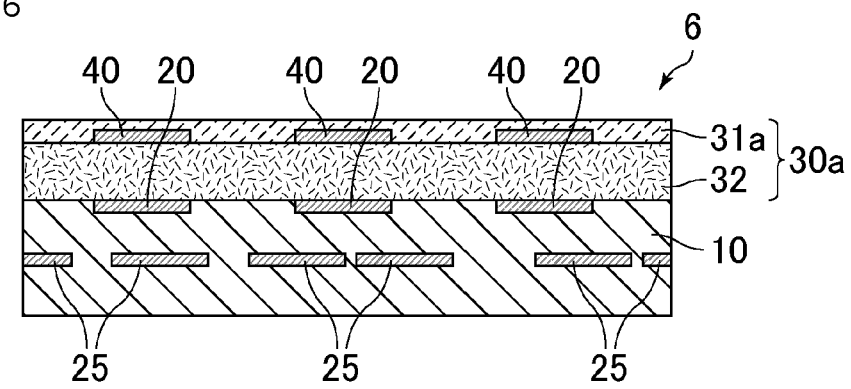
FIG. 6 is a schematic sectional view of an example of an antenna-attached substrate according to a sixth embodiment of the present disclosure.

FIG. 6 is a schematic sectional view of an example of an antenna-attached substrate according to the sixth embodiment of the present disclosure. An antenna-attached substrate 6 illustrated in FIG. 6 includes the substrate layer 10, the lower antenna elements 20 that are disposed in the substrate layer 10, an antenna-holding layer 30*a* that is stacked on the upper surface of the substrate layer 10, and the upper antenna elements 40 that are disposed in the antenna-holding layer 30*a*. The upper antenna elements 40 face the upper surfaces of the lower antenna elements 20. The substrate layer 10 includes the wiring lines 25 as needed.

As illustrated in FIG. 6, the antenna-holding layer 30*a* includes a first antenna-holding layer 31*a* that covers the upper surface of each upper antenna element 40, and the second antenna-holding layer 32 that covers the lower surface of the upper antenna element 40.

In the antenna-attached substrate 6 illustrated in FIG. 6, the first antenna-holding layer 31*a* is composed of a material that differs from that of the second antenna-holding layer 32.

The structure of the antenna-attached substrate 6 illustrated in FIG. 6 is common to that of the antenna-attached substrate 1 illustrated in FIG. 1 except that the first antenna-holding layer is composed of a material that differs from that of the second antenna-holding layer.

Also, according to the sixth embodiment of the present disclosure, the entire surface of each upper antenna element can be covered by the antenna-holding layer, and the same affects as those according to the first embodiment of the present disclosure can be achieved.

In the antenna-attached substrate according to the sixth embodiment of the present disclosure, the material of the first antenna-holding layer can be a low-cost film that is easy to handle, such as a typical dry film resist. The use of the film enables material costs to be decreased and to be processed with low-cost equipment and enables the manufacturing costs to be decreased.

In the antenna-attached substrate according to the sixth embodiment of the present disclosure, the relative dielectric constant of the first antenna-holding layer may be higher than the relative dielectric constant of the second antenna-holding layer. In this case, the relative dielectric constant of the first antenna-holding layer can be lower than the relative dielectric constant of the substrate layer. From the perspective of stability of the antenna characteristics, the relative dielectric constant of the first antenna-holding layer can be equal to or less than 200% of the relative dielectric constant of the second antenna-holding layer.

In the antenna-attached substrate according to the sixth embodiment of the present disclosure, the thickness of the first antenna-holding layer is more than that of each upper antenna element as described according to the first embodiment. The thickness of the portion of the antenna-holding layer that covers the upper surface of each upper antenna element can be, for example, 30 μm or less.

In the antenna-attached substrate according to the sixth embodiment of the present disclosure, the lower antenna elements and the upper antenna elements may be formed by multiple patterns or may be formed by a single pattern. In any case, the lower antenna elements and the upper antenna elements can be disposed so as to overlap in the thickness direction.

In the antenna-attached substrate according to the sixth embodiment of the present disclosure, the degree of the surface roughness of the upper surface of each upper antenna element can be greater than the degree of the surface roughness of the lower surface.

In the antenna-attached substrate according to the sixth embodiment of the present disclosure, each upper antenna element may have a reversely tapered shape the upper surface of which has an area smaller than the area of the lower surface.

In the case where the antenna-holding layer includes the first antenna-holding layer and the second antenna-holding layer in the antenna-attached substrate according to the sixth embodiment of the present disclosure, each upper antenna element may be partly embedded in the second antenna-holding layer.

In the antenna-attached substrate according to the sixth embodiment of the present disclosure, the area of the lower surface of each upper antenna element may be larger than the area of the upper surface of the facing lower antenna element.

In the antenna-attached substrate according to the sixth embodiment of the present disclosure, the upper surface of each lower antenna element may be covered by the substrate layer.

Antenna Module

An antenna module according to the present disclosure includes an antenna-attached substrate according to the present disclosure and an electronic component that is mounted on the antenna-attached substrate.

Figure 7:
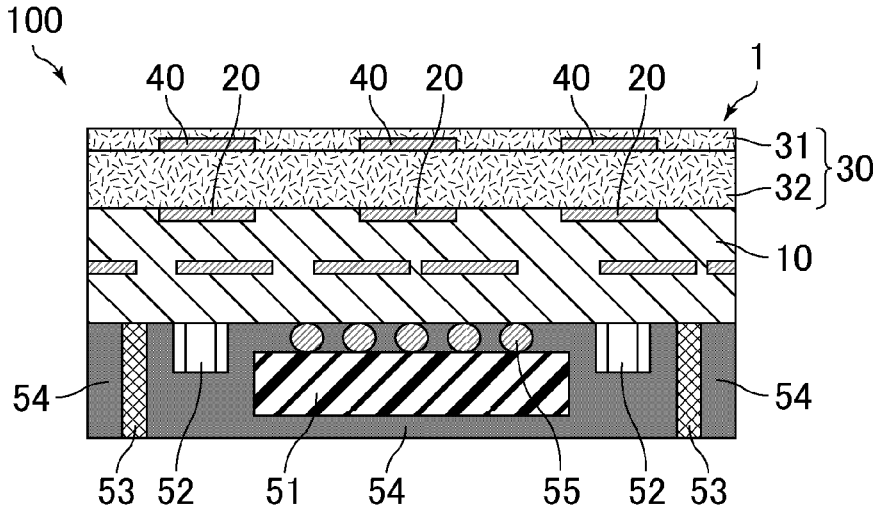
FIG. 7 is a schematic sectional view of an example of an antenna module according to the present disclosure.

FIG. 7 is a schematic sectional view of an example of an antenna module according to the present disclosure. FIG. 7 illustrates the antenna module according to the present disclosure that includes the antenna-attached substrate according to the first embodiment of the present disclosure.

An antenna module 100 illustrated in FIG. 7 includes the antenna-attached substrate 1 and electronic components 51 and 52 that are mounted on the antenna-attached substrate 1.

The structure of the antenna-attached substrate 1 is described above with reference to FIG. 1. That is, the antenna-attached substrate 1 includes the substrate layer 10, the lower antenna elements 20 that are disposed in the substrate layer 10, the antenna-holding layer 30 that is stacked on the upper surface of the substrate layer 10, and the upper antenna elements 40 that are disposed in the antenna-holding layer 30. The antenna-holding layer 30 can include the first antenna-holding layer 31 and the second antenna-holding layer 32.

In the antenna module 100 illustrated in FIG. 7, the electronic components 51 and 52 are mounted on a main surface of the antenna-attached substrate 1 (referred to below as a back surface of the antenna-attached substrate 1) that is near the lower surface of the substrate layer 10. In FIG. 7, the electronic component 51 is mounted on the circuit board by using a bonding material 55, such as solder.

In the antenna module 100 illustrated in FIG. 7, external terminals 53 are disposed on the back surface of the antenna-attached substrate 1. The electronic components 51 and 52 are sealed by a sealant 54.

Examples of the electronic components include surface mount components (SMCs), such as an integrated circuit (IC) and various passive components (a capacitor, an inductor, and a resistance). From the perspective of an increase in the effective area of the antenna, the electronic components can be mounted on the back surface of the antenna-attached substrate.

The external terminals can be mounted on the back surface of the antenna-attached substrate as in the electronic components.

The antenna module can be used for, for example, high speed communication of a mobile device.

The antenna module according to the present disclosure can be manufactured, for example, in a manner in which the electronic components, such as ICs are mounted on the back surface of the antenna-attached substrate according to the present disclosure, and a mounting surface is sealed with a resin sealant. The external terminals may be disposed in a manner in which a copper post is disposed on the mounting surface before sealing with the resin sealant, and the copper post is exposed by, for example, polishing after sealing with the resin sealant.

The electronic components can be mounted by using a typical mounting process. A process of transfer molding, compression molding, or dipping of a liquid resin may be performed for sealing with the resin sealant.

The antenna-attached substrates and the antenna module according to the present disclosure are not limited to the above embodiments. For example, the structures and manufacturing conditions of the antenna-attached substrates and the antenna module can be applied and modified in various ways within the scope of the present disclosure.

For example, in the case where the antenna-holding layer includes the first antenna-holding layer and the second antenna-holding layer, an antenna-attached substrate according to the present disclosure may include at least one third antenna-holding layer between the first antenna-holding layer and the second antenna-holding layer. In this case, the third antenna-holding layer may be composed of the same material as the first antenna-holding layer and the second antenna-holding layer, or may be composed of a different material. There may be only the single antenna-holding layer.

REFERENCE SIGNS LIST

1, 2, 3, 4, 5, 6 antenna-attached substrate
10 substrate layer
20 lower antenna element
25 wiring line
30, 30*a* antenna-holding layer
31, 31*a* first antenna-holding layer
32 second antenna-holding layer
40, 41, 42 upper antenna element
51, 52 electronic component
53 external terminal
54 sealant
55 bonding material
100 antenna module

The invention claimed is:

1. A substrate having an antenna comprising:

a substrate layer that includes a ceramic or resin material, the substrate layer being a multilayer structure;

a lower antenna element that is disposed in the substrate layer;

an antenna-holding layer that is stacked on an upper surface of the substrate layer; and an upper antenna element that is disposed in the antenna-holding layer and that faces an upper surface of the lower antenna element, wherein the antenna-holding layer is composed of a dielectric material having a relative dielectric constant lower than a relative dielectric constant of the substrate layer, wherein a lower surface, a side surface, and an upper surface of the upper antenna element are covered by the antenna-holding layer, and wherein the substrate layer further includes one or more wiring lines that are completely disposed therein and that are disposed below the lower antenna element.

2. The substrate according to claim 1, wherein a degree of surface roughness of the upper surface of the upper antenna element is greater than a degree of surface roughness of the lower surface of the upper antenna element.

3. The substrate according to claim 2, wherein the upper antenna element has a reversely tapered shape, an upper surface of the reversely tapered shape of the upper antenna element has an area smaller than an area of a lower surface of the reversely tapered shape of the upper antenna element.

4. The substrate according to claim 2, wherein the antenna-holding layer includes a first antenna-holding layer that covers the upper surface of the upper antenna element and a second antenna-holding layer that covers the lower surface of the upper antenna element.

5. The substrate according to claim 1, wherein the upper antenna element has a reversely tapered shape, an upper surface of the reversely tapered shape of the upper antenna element has an area smaller than an area of a lower surface of the reversely tapered shape of the upper antenna element.

6. The substrate according to claim 1, wherein the antenna-holding layer includes a first antenna-holding layer that covers the upper surface of the upper antenna element and a second antenna-holding layer that covers the lower surface of the upper antenna element.

7. The substrate according to claim 6, wherein a part of the upper antenna element is embedded in the second antenna-holding layer.

8. The substrate according to claim 5, wherein the antenna-holding layer includes a first antenna-holding layer that covers the upper surface of the upper antenna element and a second antenna-holding layer that covers the lower surface of the upper antenna element.

9. The substrate according to claim 7, wherein the first antenna-holding layer is composed of the same material as a material of the second antenna-holding layer.

10. The substrate according to claim 7, wherein the first antenna-holding layer is composed of a material that differs from a material of the second antenna-holding layer.

11. The substrate according to claim 6, wherein the first antenna-holding layer is composed of the same material as a material of the second antenna-holding layer.

12. The substrate according to claim 6, wherein the first antenna-holding layer is composed of a material that differs from a material of the second antenna-holding layer.

13. The substrate according to claim 12, wherein a relative dielectric constant of the first antenna-holding layer is higher than a relative dielectric constant of the second antenna-holding layer.

14. The substrate according to claim 6, wherein the lower surface of the upper antenna element is flush with a boundary between the first antenna-holding layer and the second antenna-holding layer.

15. The substrate according to claim 1, wherein an area of the lower surface of the upper antenna element is larger than an area of the upper surface of the lower antenna element that is facing the upper antenna element.

16. The substrate according to claim 1, wherein the upper surface of the lower antenna element is covered by the substrate layer.

17. An antenna module comprising:

the substrate according to claim 1; and an electronic component that is mounted on the substrate.

18. The antenna module according to claim 17, wherein the electronic component is mounted on a lower surface of the substrate layer.

19. The antenna module according to claim 17, wherein the one or more wiring lines are disposed above the electronic component.

20. The substrate according to claim 1, wherein the upper surface of the lower antenna element is flush with a boundary between the substrate and the antenna-holding layer.

* * * * *